US007188819B2

(12) United States Patent
Thurmann et al.

(10) Patent No.: US 7,188,819 B2
(45) Date of Patent: Mar. 13, 2007

(54) OBJECT-SUPPORT COLUMN

(75) Inventors: Peter Thurmann, Koblenz (DE); Stephan Enders, Koblenz (DE)

(73) Assignee: Stabilus GmbH, Koblenz (DE)

( * ) Notice: Subject to any disclaimer, the term of this patent is extended or adjusted under 35 U.S.C. 154(b) by 423 days.

(21) Appl. No.: 10/159,828

(22) Filed: May 31, 2002

(65) Prior Publication Data

US 2003/0006358 A1 Jan. 9, 2003

(30) Foreign Application Priority Data

Jun. 1, 2001 (DE) ..... 101 26 681
May 2, 2002 (DE) ..... 102 19 583

(51) Int. Cl.
*F16M 13/00* (2006.01)

(52) U.S. Cl. ..... 248/631; 248/161

(58) Field of Classification Search ..... 248/161, 248/157, 188.5, 631, 622, 562; 297/344.19, 297/344.18; 267/64.12, 64.26; 188/322.19
See application file for complete search history.

(56) References Cited

U.S. PATENT DOCUMENTS 4,245,826 A * 1/1981 Wirges ..... 267/131
4,465,266 A * 8/1984 Hale ..... 267/131
4,720,068 A * 1/1988 Tornero ..... 248/161
4,848,524 A * 7/1989 Hosan ..... 188/322.17
5,570,873 A * 11/1996 Bauer ..... 267/64.12
5,979,845 A * 11/1999 Battey ..... 248/161
5,992,815 A * 11/1999 Metzdorf ..... 248/631
6,007,044 A 12/1999 Harrer
6,102,354 A * 8/2000 Thorn ..... 248/406.2
6,241,316 B1 * 6/2001 Jean ..... 297/344.19

FOREIGN PATENT DOCUMENTS

| | | |
|---|---|---|
| DE | 562 064 | 10/1932 |
| DE | 657 319 | 2/1938 |
| EP | 0 366 128 | 5/1990 |
| FR | 2 661 229 | 10/1991 |
| GB | 2 197 422 | 5/1988 |

* cited by examiner

*Primary Examiner*—Gwendolyn Baxter
(74) *Attorney, Agent, or Firm*—Cohen Pontani Lieberman & Pavane LLP

(57) ABSTRACT

Object-support column includes an end unit, a guide tube which has a nominal diameter, and end having an end diameter which is smaller than the nominal diameter, and a transition-length portion extending from the nominal diameter to the end diameter, the end being connected to the end unit. A pneumatic tube surrounds the guide tube and the end unit, the pneumatic tube having a conical section with a diameter reduction surrounding the end unit. Alternatively, a guide portion of the guide tube may be supported radially on the inner wall of the pneumatic tube.

15 Claims, 3 Drawing Sheets

1

OBJECT-SUPPORT COLUMN

BACKGROUND OF THE INVENTION

1. Field of the Invention

The invention relates to an object-support column of the type including an end unit, a guide tube having an end which is connected to the end unit, and a pneumatic tube surrounding the guide tube and the end unit, the pneumatic tube having a conical section with a diameter reduction surrounding the end unit.

2. Description of the Related Art

Object-support columns of this type are used, for example, in vertically adjustable chairs or tables. For attaching the object-support column, for example, to a chair support, a pneumatic tube is configured with a diameter reduction at one end. This diameter reduction may be, for example, of conical form. For multiple usage, the cone is standardized in its dimensions.

This makes it possible for the object-support column to be exchanged irrespective of a particular manufacturer. Arranged within the pneumatic tube is a guide tube in which, in turn, a displacer, usually a piston rod with a piston, is guided in an axially moveable manner. Installed as an end unit at the end which is directed toward the diameter reduction is a valve housing in which a switchable valve which influences a flow connection as a fluid connection between the guide tube and an annular space running between the pneumatic tube and the guide tube is arranged. The valve housing has a guide stub which is pushed into the guide tube. By way of its outer contour, the valve housing is supported on the inner wall of the pneumatic tube and thus centers the guide tube in relation to the pneumatic tube.

The displacement length of the object-support column is dependent on the useable length of the guide tube minus the length of the piston. If it is necessary to maintain a predetermined spacing between the diameter reduction and the other end of the pneumatic tube, then there is no point in shortening the valve housing between the end of the guide tube and the inner wall of the pneumatic tube in order to assign the saved length to the guide tube. If the guide tube were to be lengthened, it would butt against the pneumatic tube in the inner region of the diameter reduction and the above-described annular space would no longer exist.

Alternatively, it would be possible to shorten the guide stub, but the increases in length which can be achieved are rather modest. In addition, or alternatively, it would be possible to reduce the wall thicknesses of the guide tube and of the pneumatic tube and, with a given external diameter of the pneumatic tube and with an identical internal diameter of the guide tube, to achieve a wider annular space. It would thus be possible, in turn, to lengthen the guide tube until a minimum spacing has been reached between the end-side outer edge of the guide tube and the nearest region of the inner wall of the pneumatic tube. In the case of a product which has already been in use for a long time, the wall thicknesses are largely used up. Even smaller wall thicknesses would require high-strength materials which, in turn, have an adverse effect on the cost.

SUMMARY OF THE INVENTION

The object of the present invention is to optimize an object-support column in respect of its displacement length.

According to the invention, the end of the guide tube which is directed toward the end unit has a transition-length portion which terminates in a diameter which is smaller than the nominal diameter.

In comparison with the prior art, the end unit is shifted axially in the direction of the end of the pneumatic tube. This shift may be utilized as an increase in the useable capacity of the guide tube. Irrespective of a diameter reduction of the pneumatic tube, a very narrow structural unit comprising end unit and guide tube is obtained, it being possible for the end unit, rather than absolutely having to be used for a valve, also to be configured as a piston-rod guide or as a straightforward plug.

High-strength materials in particular can only be deformed to a limited extent with low levels of stressing and cracking. It has thus been found to be particularly advantageous if the transition-length portion is of conical configuration.

As an alternative, however, provision may also be made for the transition-length portion to be configured in the form of a bottleneck. In the case of such a solution, it is possible to use a comparatively long end unit. It is also possible, however, for the transition-length portion to have a base. It is thus possible for the end unit to be supported axially on the guide tube.

For the case where the end unit has to center the guide tube, the transition-length portion is adjoined by a guide portion. The latter may, alternatively, also be supported radially on the inner wall of the pneumatic tube. It is thus not necessary for the end unit to perform any centering function.

Provision may be made here for the guide portion to be formed by a collar which is configured at least in certain sections. A continuously encircling collar is not necessary since, in particular when the end unit is utilized as a valve housing, at least one gap has to be maintained as a fluid connection between the guide tube and the pneumatic tube.

It is alternatively possible for the guide tube to be centered in relation to the pneumatic tube by means of a spacer ring. By means of a very straightforward spacer ring, it is possible to dispense with a guide section and to simplify the geometry of the end unit.

In a further configuration, the guide portion may have a bead for a seal. This is associated with the advantage that the end unit can be produced more easily. The end unit is often produced by injection molding. Producing a component with an encircling groove requires greater outlay for demolding purposes.

Alternatively, the bottleneck-shaped transition-length portion may have at least one sealing surface for a seal in relation to the end unit. This possibility dispenses with the operation of forming the bead.

It is optionally also possible for the end unit to have a seal in relation to the pneumatic tube within a groove, the end unit being configured in two parts and a parting joint running in the region of the groove. A particularly straightforward injection mold for the end unit results, in particular, when the seal between the end unit and the guide tube is already borne by the guide tube.

In the case of an alternative solution proposal, it is possible for the guide tube, starting from its nominal diameter, to have a guide portion which is supported radially on the inner wall of the pneumatic tube. The part which, up until now, was taken up by a guide stub of the end unit in the guide tube is gained as a useable increase in length for the guide tube.

In this case, the guide portion may be formed by a collar which is configured at least in certain sections.

The invention will be explained in more detail with reference to the following description of the figures.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
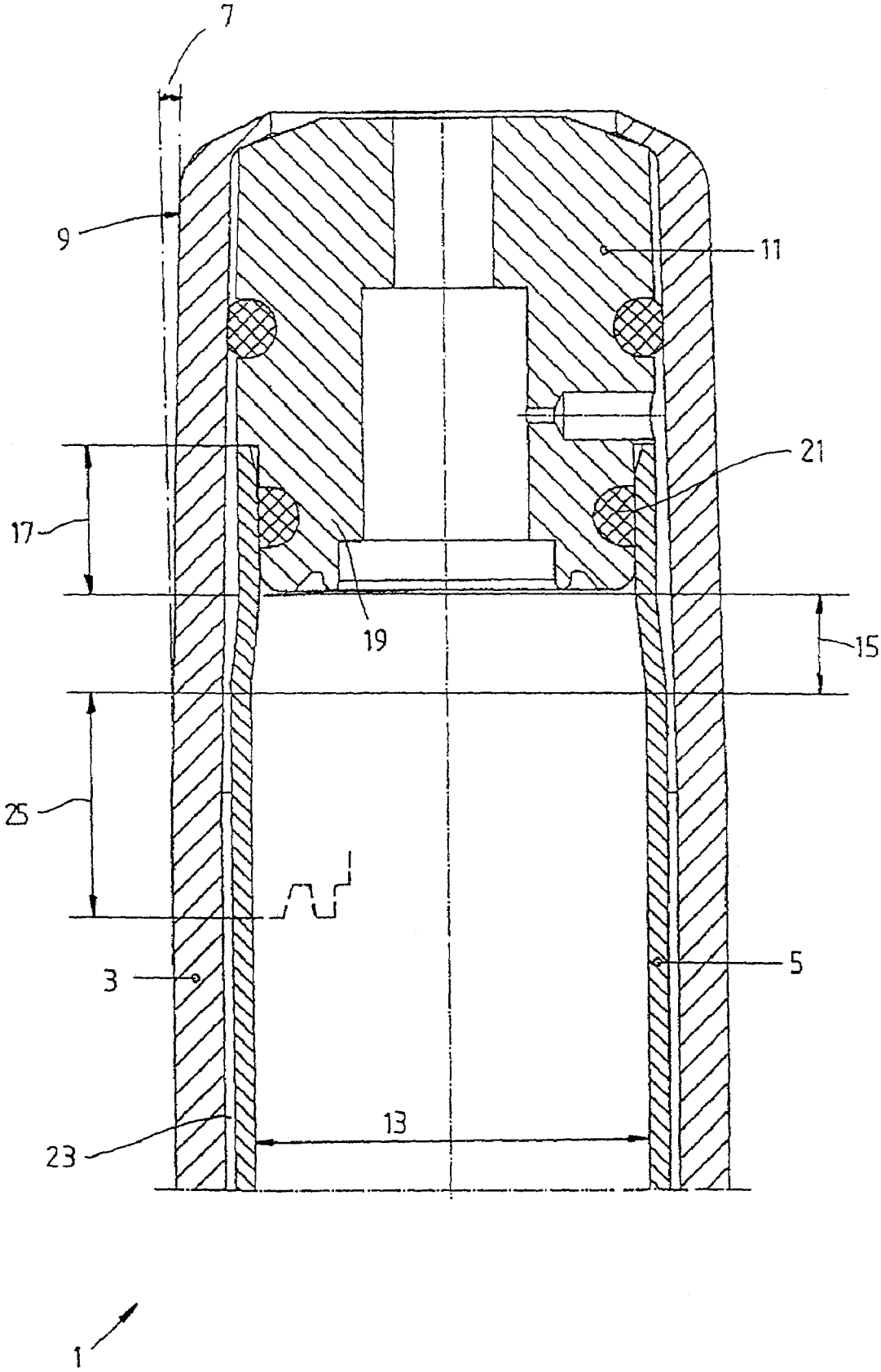
FIG. 1 is an axial section view of an object-support column with a conical transition-length portion.

FIG. 1 shows the parts of an object-support column 1 according to the invention as are used for tables, chairs or other applications. A guide tube 5 is arranged within a pneumatic tube 3. The pneumatic tube has a diameter reduction 7 which is determined by an end section 9 shaped like a cone, it also being possible for the diameter reduction, which may also be configured just in part, e.g. in the form of an indent, to be formed by some other configuration of the pneumatic tube.

Fitted in the end section 9 toward the end of the pneumatic tube 3 is an end unit 11, which performs the function of a valve housing. A seal 20 is provided between the end unit 11 and the pneumatic tube 3 to contain the fluid. A configuration as a piston-rod guide or as a straightforward closed end plug is also conceivable.

A nominal diameter 13 of the guide tube 5, which may serve as a passageway for a piston (not illustrated), is followed by a transition-length portion 15 which, in this exemplary embodiment, is likewise shaped conically. The end of the guide tube is formed by a guide portion 17 in which a guide stub 19 of the end unit is received. The guide portion has a constant diameter, with the result that the end unit 11 can be fitted over the open end of the guide tube. The guide stub contains a seal 21 which separates the working chamber 26 from fluid passage 23. The fluid passage 23 is formed by an annular space between the inner wall of the pneumatic tube and the outer wall of the guide tube.

By virtue of a transition-length portion 15 being integrally formed on the guide tube 5, the end unit 11, in practice, is displaced further in the axial direction into the end section 9 of the pneumatic tube 3. It is possible to dimension the useable length of the guide tube to just before the start of the diameter reduction of the pneumatic tube and to form the transition-length portion 15 integrally following this in the axial direction. For comparison, the positioning of the end unit which is known from the prior art is illustrated by dashed lines. In the case of a sample produced by the applicant, with the wall thicknesses, diameters and lengths otherwise unchanged, the useable increase 25 in displacement length is approximately 30 mm.

Figure 2A:
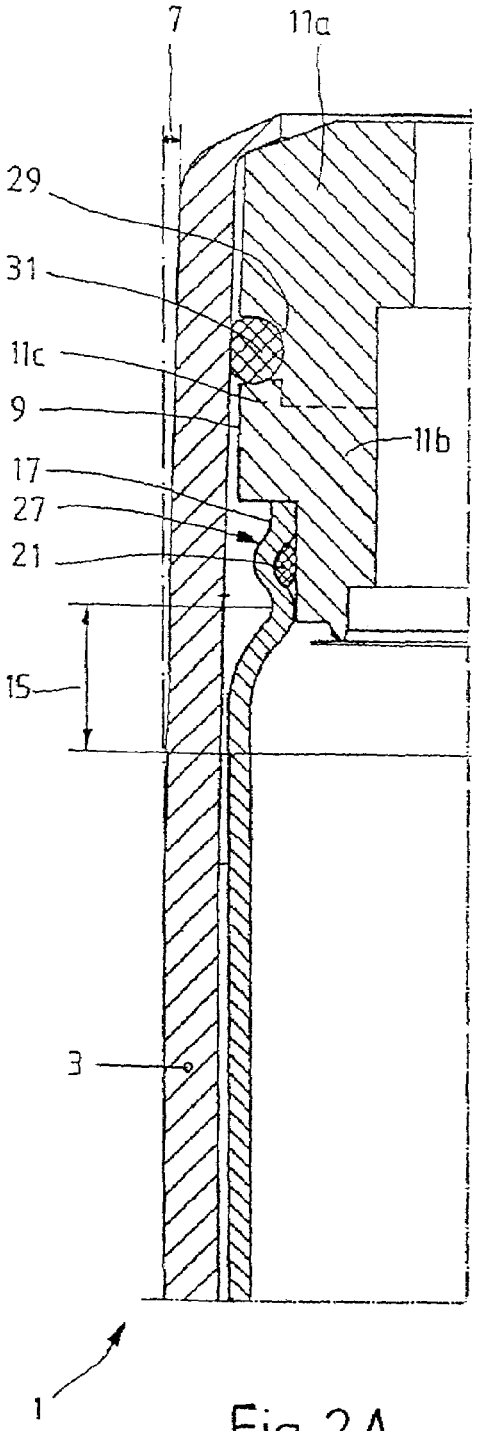
FIGS. 2A and 2B are half section views of an object-support column with seals which are supported by the guide tube.
Figure 2B:
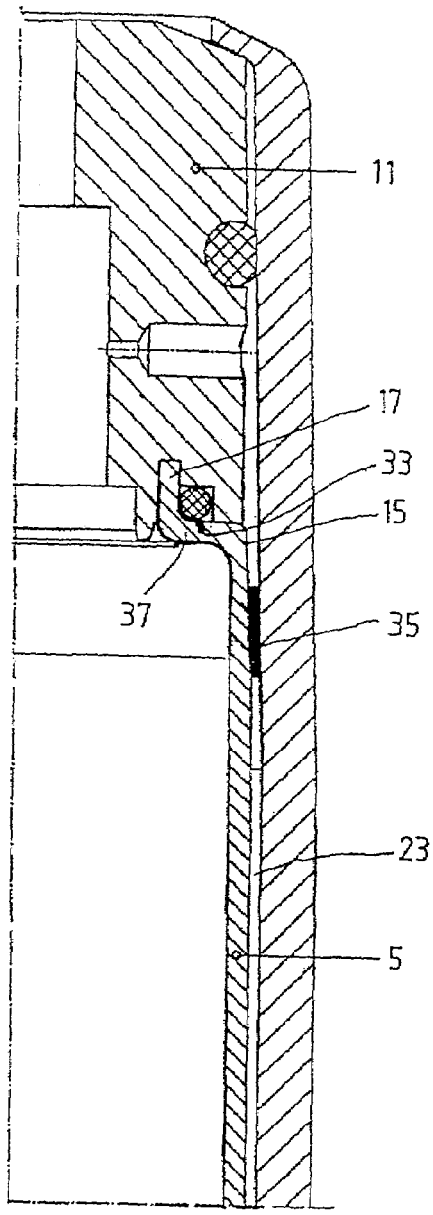

FIGS. 2A and 2B show two variants. In the left-hand half section of FIG. 2A, the guide portion 17 has a bead 27 for the seal 21. For this purpose, the end diameter of the guide tube has been reduced somewhat in comparison with the variant according to FIG. 1 in order to provide the necessary installation space in the radial direction.

Furthermore, the end unit 11, in the region of a groove 29 for a seal 31 between the end unit and the inner wall of the pneumatic tube, has optionally been divided into a first and a second portion 11*a*; 11*b*. As can be seen, these two portions of the end unit can be produced particularly straightforwardly by injection molding without radial undercuts. An axially running centering portion 11*c* is provided between the two portions 11*a*; 11*b* of the end unit, with the result that the guide tube 5 also continues to be aligned in relation to the pneumatic tube via the end unit 11.

The right-hand half section of FIG. 2B shows a guide tube 5 with a bottleneck-shaped transition-length portion 15. The seal 21 is supported on a radially running sealing surface 33 of the guide tube, with the result that it is also the case with this variant that there is no need for any encircling groove to be made in the end unit. A guide portion 17 may be formed in the guide tube. Alternatively, however, it is possible for a spacer ring 35 to be used instead of the guide portion 17 and for only a base 37 of the transition-length portion to be utilized, it being possible for the end unit to be supported on the base. The advantage of this measure is that the guide tube is centered directly in relation to the pneumatic tube and, at the same time, it is possible to dispense with the outlay for deforming the guide tube to produce the guide portion. The spacer ring 35 is slit, or only configured with a circumference of somewhat more than 180 degrees, in order for the fluid connection 23 not to be blocked.

Figure 3A:
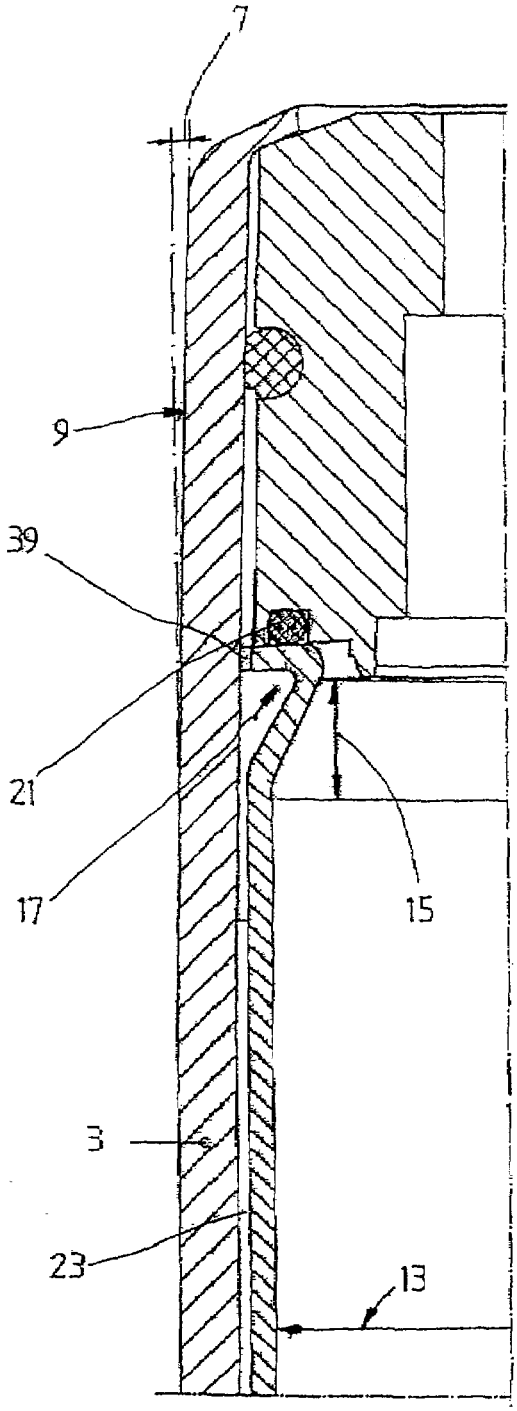
FIGS. 3A and 3B are half section views of a guide tube which centers itself in the pneumatic tube.
Figure 3B:
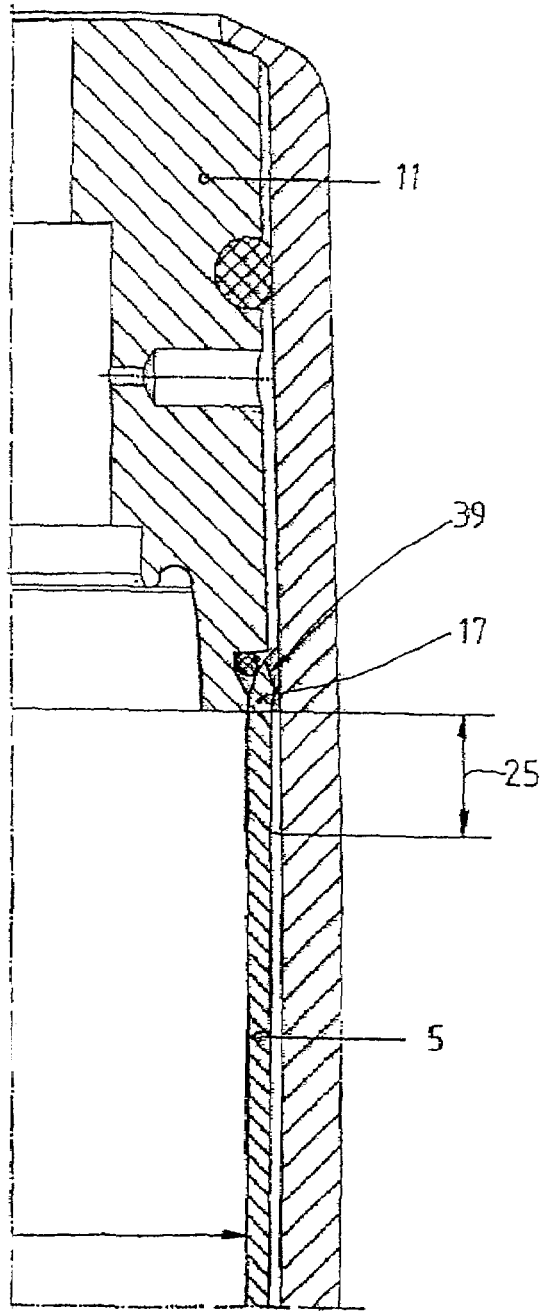

FIGS. 3A and 3B show two variants of the object-support column. In the left-hand half section of FIG. 3A, the transition-length portion 15 is adjoined by a radially outwardly directed collar-like guide portion 17, which is supported radially on the inner wall of the pneumatic tube 3. In order also to ensure the fluid connection 23 in the region of the guide portion, the collar is limited only to an angle region in the circumferential direction or cutouts 39 are provided in the border region.

In the right-hand half section of FIG. 3B, the guide portion 17 of the guide tube 5 directly adjoins the nominal diameter 13. Depending on the predetermined geometry, the increase in length of the useable guide tube may indeed be somewhat smaller in comparison with the solutions described above, but the deformation-related outlay is considerably lower. Both solutions have in common the fact that the guide tube 5 is centered directly on the pneumatic tube 3 via the guide portion 17.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An object support column comprising an end unit, a guide tube having a uniform nominal diameter, an end having an end diameter which is smaller than said nominal diameter, and a transition length portion extending from said nominal diameter to said end diameter, and a guide portion comprising a bead for a seal adjoining said transition length portion, said end being connected to said end unit, and a pneumatic tube surrounding said guide tube and forming a fluid passage between said pneumatic tube and said guide tube, said pneumatic tube having an end section with a diameter reduction surrounding said end unit, said end unit being fitted in said end section.

2. An object support column as in claim 1 wherein said transition length portion is cone shaped.

3. An object support column as in claim 1 wherein said transition length portion is bottleneck shaped.

4. An object support column as in claim 3 wherein said bottleneck shaped transition length portion comprises a sealing surface receiving a seal which seals said guide tube relative to said end unit.

5. An object support column as in claim 1 wherein said transition length portion comprises a radially extending base.

6. An object support column as in claim 1 further comprising a spacer ring which centers said guide tube relative to said pneumatic tube.

7. An object support column as in claim 1 wherein said end section is conical.

8. An object support column as in claim 1 wherein said end unit has a stub which is received in said end of said guide tube.

9. An object support column as in claim 8 further comprising a seal between said stub and said end of said guide unit.

10. An object support column as in claim 1 further comprising a seal between said end unit and said end section of said pneumatic tube.

11. An object support column as in claim 1 wherein said end section of said pneumatic tube overlaps said end of said guide tube axially.

12. An object support column comprising an end unit, a guide tube having a uniform nominal diameter, an end having an end diameter which is smaller than said nominal diameter, and a transition length portion extending from said nominal diameter to said end diameter, and a guide portion adjoining said transition length portion, said end being connected to said end unit, wherein said guide portion comprises a collar extending at least in circumferential sections, and a pneumatic tube surrounding said guide tube and forming a fluid passage between said pneumatic tube and said guide tube, said pneumatic tube having an end section with a diameter reduction surrounding said end unit, said end unit being fitted in said end section, wherein said pneumatic tube has an inner wall, said guide portion being supported radially on said inner wall.

13. An object support column comprising an end unit, a guide tube having a uniform nominal diameter, an end having an end diameter which is smaller than said nominal diameter, and a transition length portion extending from said nominal diameter to said end diameter, and a guide portion adjoining said transition length portion, said end being connected to said end unit, and a pneumatic tube surrounding said guide tube and forming a fluid passage between said pneumatic tube and said guide tube, said pneumatic tube having an end section with a diameter reduction surrounding said end unit, said end unit being fitted in said end section wherein said end unit comprises a groove receiving a seal for sealing said end unit relative to said pneumatic tube, said end unit comprising two parts fitted together at a joint adjacent to said groove.

14. An object support column as in claim 13 further comprising a guide portion adjoining said transition length portion.

15. An object support column as in claim 14 wherein said guide portion comprises a bead for a seal.

* * * * *